US005213312A

United States Patent [19]

MacDonald

[11] Patent Number: 5,213,312

[45] Date of Patent: May 25, 1993

[54] BARRIER SYSTEM AND BARRIER UNITS THEREFOR

[75] Inventor: John B. MacDonald, Brantford, Canada

[73] Assignee: Great Barrier Industries Ltd., Brantford, Canada

[21] Appl. No.: 745,691

[22] Filed: Aug. 16, 1991

[51] Int. Cl.[5] ..... E04H 17/18

[52] U.S. Cl. ..... 256/26; 160/351; 256/1; 256/73

[58] Field of Search ..... 256/1, 24, 26, 73, DIG. 6; 160/351; 482/15, 16; 211/13; 414/341

[56] References Cited

U.S. PATENT DOCUMENTS

| | | | |
|---|---|---|---|
| 247,751 | 4/1978 | Appleby | D25/45 |
| 5,105,951 | 4/1992 | Gearin et al. | 211/13 |
| 5,115,763 | 5/1992 | Wilson | 256/73 |

FOREIGN PATENT DOCUMENTS

| | | | |
|---|---|---|---|
| 679297 | 9/1952 | United Kingdom | 256/26 |

*Primary Examiner*—Randolph A. Reese
*Assistant Examiner*—Christopher J. Novosad

[57] ABSTRACT

A crowd control barrier system is formed by regular barrier units interlocked end to end, with special wheeled units at intervals which provide elevated platforms for crowd surveillance. The special units can be converted to provide mobile storage racks for the regular units, which mobile racks can be wheeled onto a trailer or other vehicle for transportation and storage. The regular barrier units are formed of two continuous tubular members, one forming a frame for a vertical panel and one side of a base frame, and the other forming the other side of the base frame and vertical members welded to vertical portions of the first member to form vertical stanchions supporting the panel.

9 Claims, 5 Drawing Sheets

BARRIER SYSTEM AND BARRIER UNITS THEREFOR

This invention relates to barriers for crowd control and other applications where temporary enclosure and surveillance of an area is required.

There are many circumstances in which temporary barriers are required for crowd control purposes, to enclose or define areas reserved for a particular purpose, or to define access routes. In many cases, some form of surveillance either of the enclosed area, or of a crowd being controlled, is required for security or other reasons. For example, processions involving public dignitaries often involve the erection of barriers to keep crowds back from the route of the procession, and the posting of police officers at frequent intervals along the barrier to maintain crowd surveillance. If a high degree of security is required, the manpower requirements for adequate surveillance along an extended route can become very large. Moreover, the setting up and subsequent removal of the barriers is a substantial task which can cause considerable disruption to traffic before and after the event to be controlled.

A barrier system for crowd control which has met with considerable acceptance makes use of the barrier elements which are the subject of U.S. Pat. No. 247,751, issued to William E. Appleby on Apr. 18, 1978. These elements can be rapidly linked together to form a strong and stable barrier. Special racks are provided for stacking the barrier elements for transportation to and from the site at which they are used, but these resulting stacks must still be loaded and unloaded from trucks or trailers, possibly using mechanical handling equipment, and the racks must be stored during use of the barrier elements.

The present invention seeks to provide a barrier system which can retain the advantages of the barrier elements of the Appleby patent, but which can be manufactured more economically, which can be erected and dismantled even more readily, and which can also permit crowd surveillance to be achieved with greater effectiveness and/or reduced manpower.

According to the invention, a portable dismountable barrier system comprises a plurality of barrier units releasably interlockable in end to end relationship to form an elongated barrier, said units comprising units of a first type and a plurality of units of a second type for each first unit, the units of the first type providing both means for supporting said plurality of second units for transportation when the barrier is in a dismounted condition, and means providing an elevated observation post when the barrier is in an assembled condition.

The units of the second type may be units such as those shown in the Appleby patent, but are preferably improved units described hereinafter whilst the units of the first type have a first, folded condition in which they form a rack on which units of the first type may be stacked, and a second extended condition in which they form an elevated observation post incorporating means for locking it to adjacent units of the second type. Preferably, the units of the first type are mounted on wheels, and preferably the system further includes a wheeled trailer with a loading ramp such that units of the first type may be wheeled on and off the trailer.

The invention also extends to a barrier unit comprising; a panel support frame element having spaced vertical members in a common vertical plane, a barrier panel extending between said vertical members in said vertical plane, and a horizontal member connecting bottom ends of said vertical members and forming a loop extending laterally to one side of said vertical plane, said vertical and horizontal members being formed by a single length of rigid tubing, a perimeter frame element formed by a closed loop of rigid tubing, said perimeter frame element comprising vertical portions adjacent and secured to said vertical members to form end stanchions, a lower horizontal portion forming a loop extending laterally to an opposite side of said vertical plane, and an upper horizontal portion in said vertical plane above said barrier panel; vertically spaced hooks secured to one of said end stanchions, and vertically spaced eyes secured to the other of said end stanchions to receive the hooks of an adjacent barrier unit. Such a barrier unit provides substantial advantages discussed later in this specification.

Further features of the invention will become apparent from the following description with reference to the accompanying drawings, in which.

Figure 1:
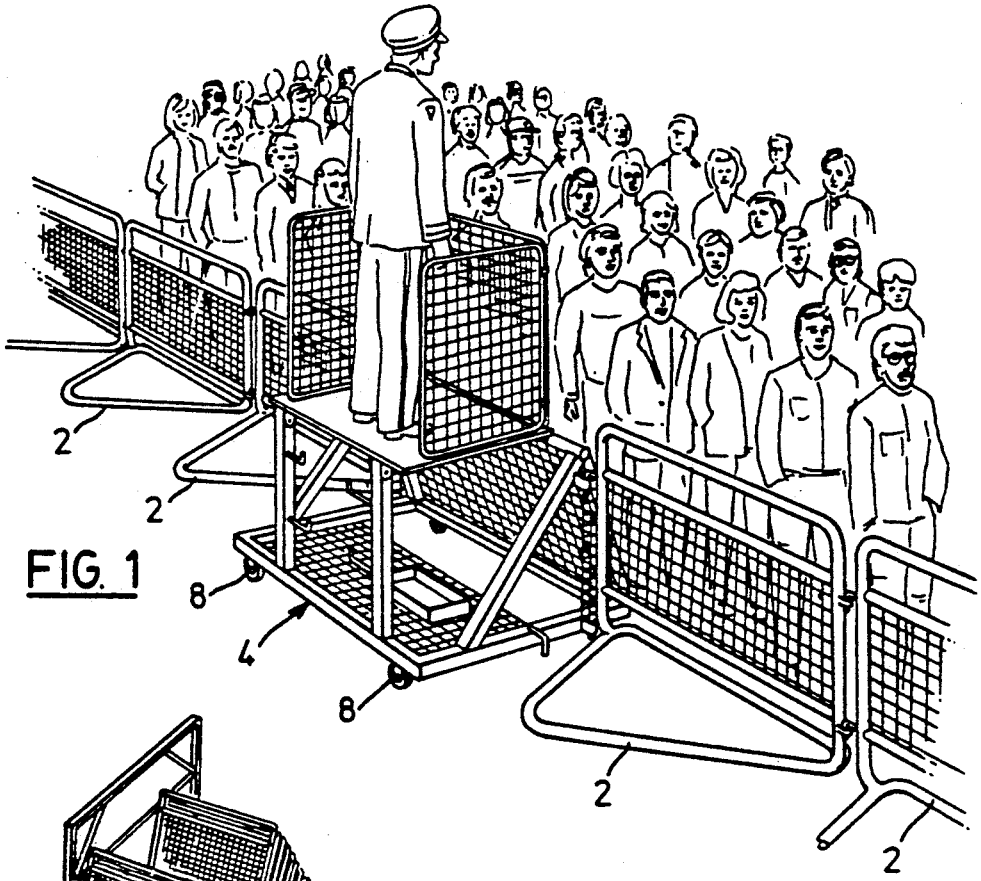
FIG. 1 is a diagrammatic perspective view showing a system in accordance with the invention in use for crowd control purposes.
Figure 2:
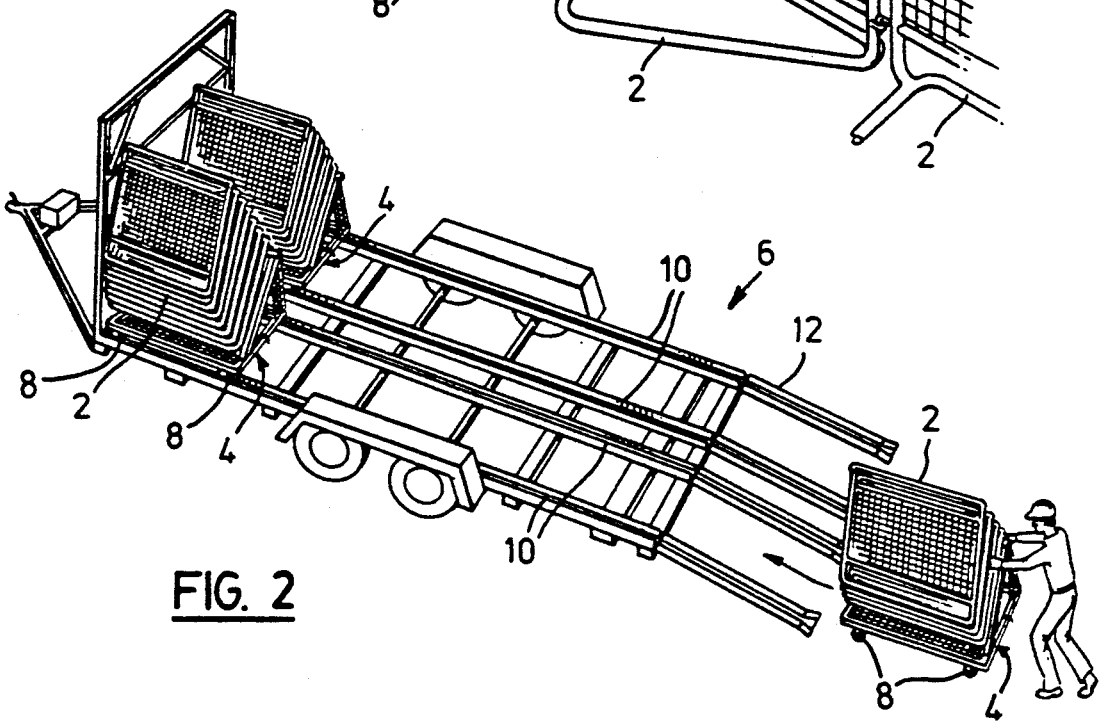
FIG. 2 is a diagrammatic perspective view showing the system in substantially dismantled condition.
Figure 3:
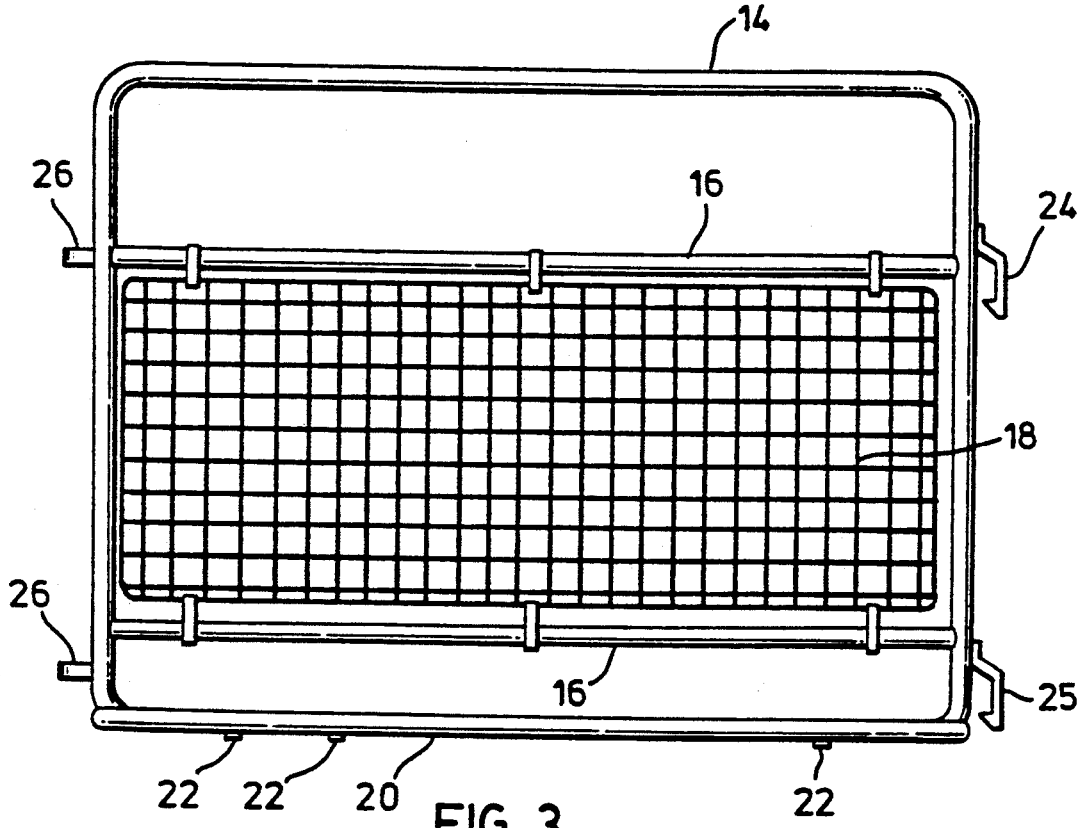
FIG. 3 is an elevation of a regular barrier unit.

Referring to FIGS. 1, 2 and 3, the barrier system shown comprises three main elements, firstly regular barrier units 2, secondly, combination barrier/rack/observation platform units, and thirdly a road trailer 6. The system is taken to a site where it is to be erected with the units 2 stacked on the folded units 4, which are supported on trolley wheels 8 so that they may be wheeled on and off the trailer 6 on tracks 10 formed on the trailer bed and on a combined tailgate and loading ramp 12. The construction and running gear of the trailer 6 is conventional, and it is not thought that further description is needed. The trailer 6 could of course be replaced by a semitrailer or self-propelled vehicle.

Upon arrival at site, each unit 4 is wheeled off the trailer and thence to a point of deployment at which individual units 2 are unloaded from the unit 4 and linked end to end to form a barrier.

Figure 8:
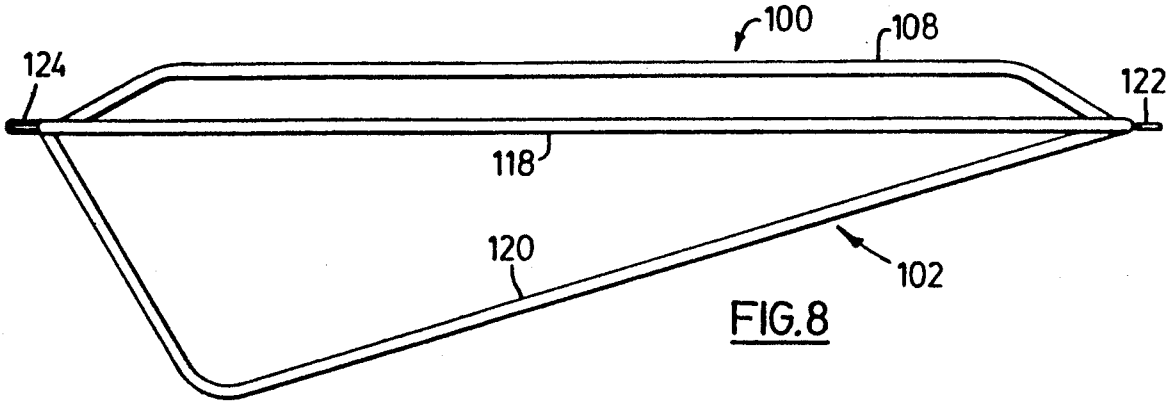
FIGS. 8, 9 and 10 are plan, side elevational and end elevational views showing an improved barrier unit.
Figure 9:
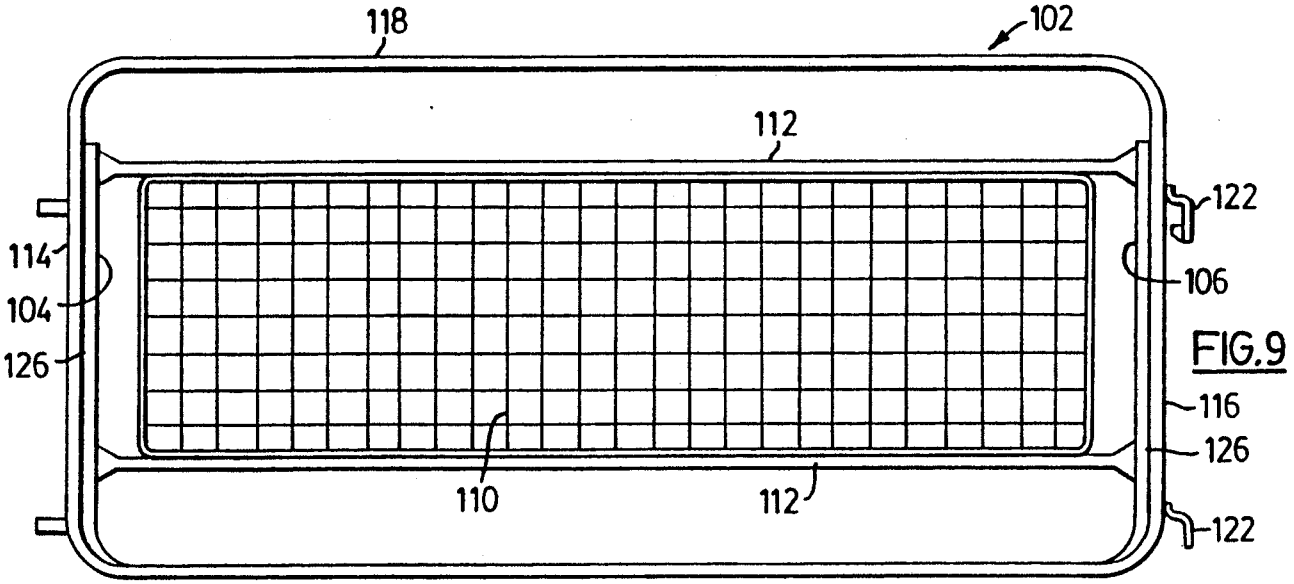
Figure 10:
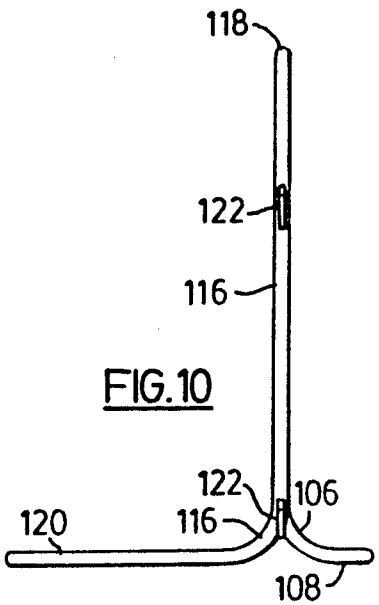

The units 2 may be similar to those shown in U.S. Pat. No. 247,751, and as shown in FIG. 3 comprise a vertical tubular frame 14, with cross bars 16 supporting a wire mesh screen 18, a triangular tubular base 20 with small gripping studs 22, hooks 24 and 25 on one side of the frame and eyes 26 on the other side of the frame. The hook 24 is barbed so as to prevent disengagement of units one from another by lifting once the hooks are engaged within the eyes of an adjacent unit and the units drawn apart under tension. Experience has shown that a barrier formed of such units performs well in practice since its stability and its resistance to disengagement of the individual units increases with crown pressure, whilst the units are readily engaged and disengaged when free of crowd pressure by working from one or both ends of a row of units. The units shown in FIG. 3 are not of themselves new. They can however advantageously be replaced by new and improved barrier units as shown in FIGS. 8, 9 and 10 and described further below. Other barrier units of adequate performance and capable of end to end interlocking may also be substituted provided that they are compatible with the units 4 to be described further below with reference to FIGS. 4–7.

The units 4 perform a triple function. Firstly, such a unit provides a mobile support rack for a number, typically 25, of units 2. To this end, the unit has a rectangular base frame 30 supported on trolley wheels 32, and a stacking horse comprising V-frames formed by struts 34 and 36 and a tubular horizontal cross-bar 38. The units 2 are stacked on the horse so that the vertical frames lie on one side and the triangular base frames on the other side, as schematically shown in FIG. 2.

It is important that the unit 4 have a stable footing when assembled into a barrier to form an elevated observation platform, since any real or apparent unsteadiness or instability is likely to be unacceptable to persons using the platform. Whilst the provision of wheels 32 at each corner of the platform will resist gross tipping of the platform, the ground or pavement on which the unit 14 is located will often be sufficiently uneven to prevent all four wheels from contacting the ground simultaneously, resulting in a limited but undesirable degree of unsteadiness. Moreover in such an arrangement, the wheels at one end of the platform should be able to swivel in order to permit the unit to be manoeuvred into position. A three wheeled suspension overcomes this unsteadiness problem and requires only one swivel wheel, but is less resistant to tipping and requires extra tracks on the trailer 6. In practice, it will be desirable to provide the unit with a levelling jack system so that once the platform is positioned, it can be stabilized against rocking and tipping. In one economical arrangement, non-swivelling corner wheels are provided at one end only of the platform, a leg 14 is provided at the crowd side corner at the opposite end, and a screw jack at the remaining corner, the unit being moved into position by a dolly engaged with and lifting the non-wheeled end of the platform. This arrangement has the advantage of eliminating the need for swivel wheels and requires only one levelling jack, which can be located out of reach of a crowd being controlled.

Since the unit 4 is also required to function as a barrier unit and an observation platform, it includes additional components to suit it for this purpose. Several embodiments of unit 4 including such additional components are shown in FIGS. 4 and 5, FIG. 6 and FIG. 7 respectively.

Figure 5:
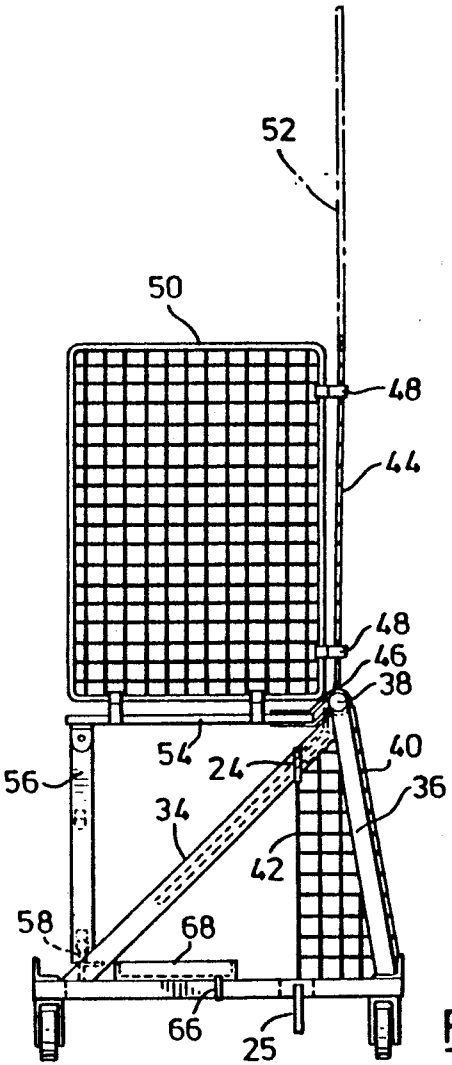
FIG. 5 is an end elevation of the unit shown in FIG. 4.
Figure 4:
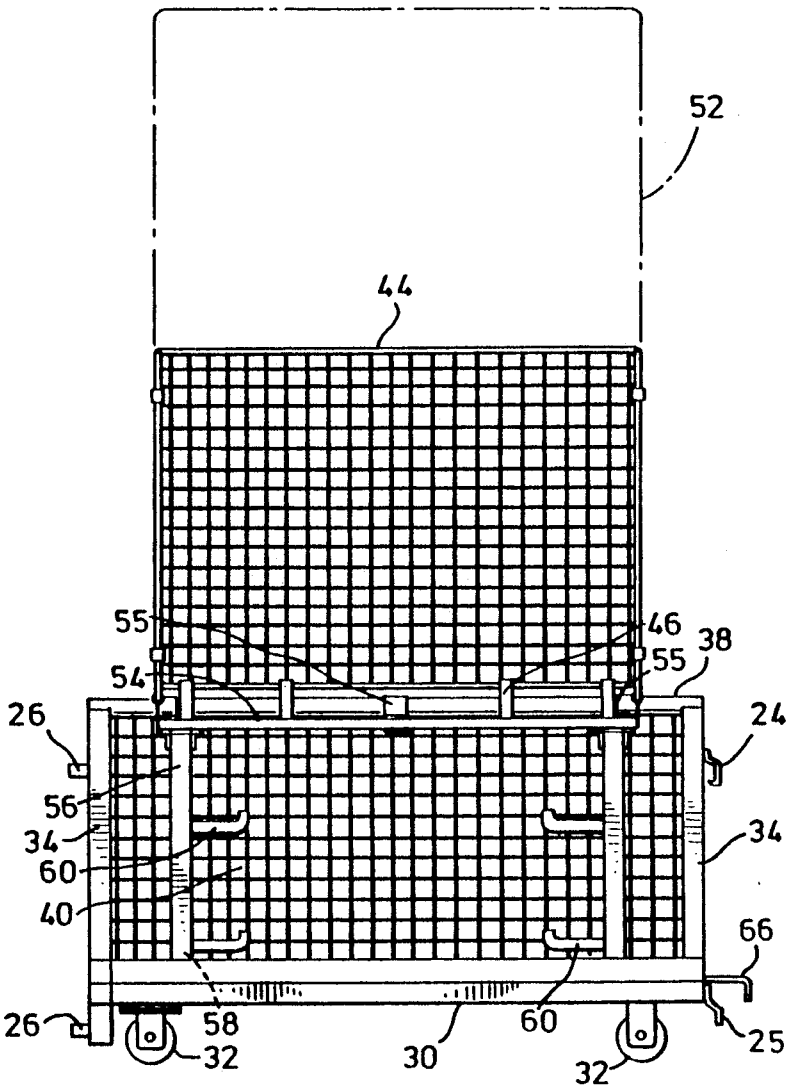
FIG. 4 is an away-from-crowd side elevation of a first embodiment of barrier support rack unfolded to form a barrier section including an elevated observation platform.

Referring to FIGS. 4 and 5, the struts 36 support wire mesh consisting of a longitudinal screen 40 and end screens 42 which extend from the crowd side of the unit rearward to the plane in which it is connected to adjacent units 2. In this plane, the base frame 30 and the struts 34 support hooks 25 and 24 at one end of the unit, and eyes 26 at the other end of the unit, to permit its connection to adjacent units 2. The screens 40 and 42 thus provide a continuous barrier when the unit is so connected.

In the simplest form of the unit, the base frame 30 or a mounting block located upon it forms a slightly elevated platform which permits a police constable or other security official to conduct enhanced surveillance of a crowd being controlled. It is, however, preferred to provide additional folding structure providing additional elevation and protection of the platform. To this end, a screen 44 is hinged by straps 46 to the tubular cross-bar 38 so that it may be swung from a position in the plane of the struts 34 to a position vertically above the cross-bar 38. Optionally the height of the front screen may be increased by a further screen 52 hinged to the top edge of the screen 44. A platform 54 for providing a more elevated surveillance position is hingedly suspended from the cross-bar 38 by straps 5, and may be swung upwardly to the horizontal position shown in the Figures, in which it is supported by hinged struts 56 which are locked in a vertical position by pins 58 projecting upwardly from the platform. Access to the platform 54 is by means of steps 60 secured to the struts 56. Hinged to the ends of the platform 54 are side screens 50 which may be swung up from a position overlying the platform to the position shown, in which they are locked to the screen 44 by clips 48 to form a rigid three sided structure.

Figure 6:
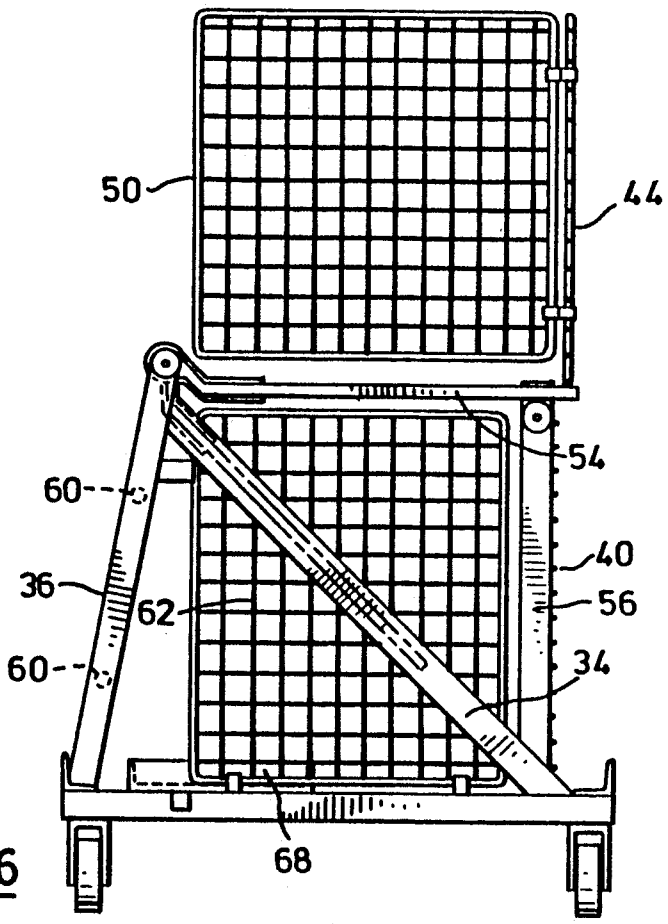
FIG. 6 is an end elevation of a second embodiment of support rack in unfolded condition.

In some cases, it may be preferred to have observation platforms which project into rather than away from the crowd. Such an arrangement is shown in FIG. 6. In this Figure, the basic construction is generally the same, except that the opposite side of the unit faces the crowd. The screen 40 is therefore attached to the struts 56, the steps 60 are transferred to the struts 36, and the screen 44 is hinged to the free edge of the platform 54. The screens 46 are replaced by enlarged screens 62 hinged at their bottom edges to the platform from which they can be swung up to a vertical position as shown so as to shut off crowd-side access to the space beneath the platform 54.

Figure 7:
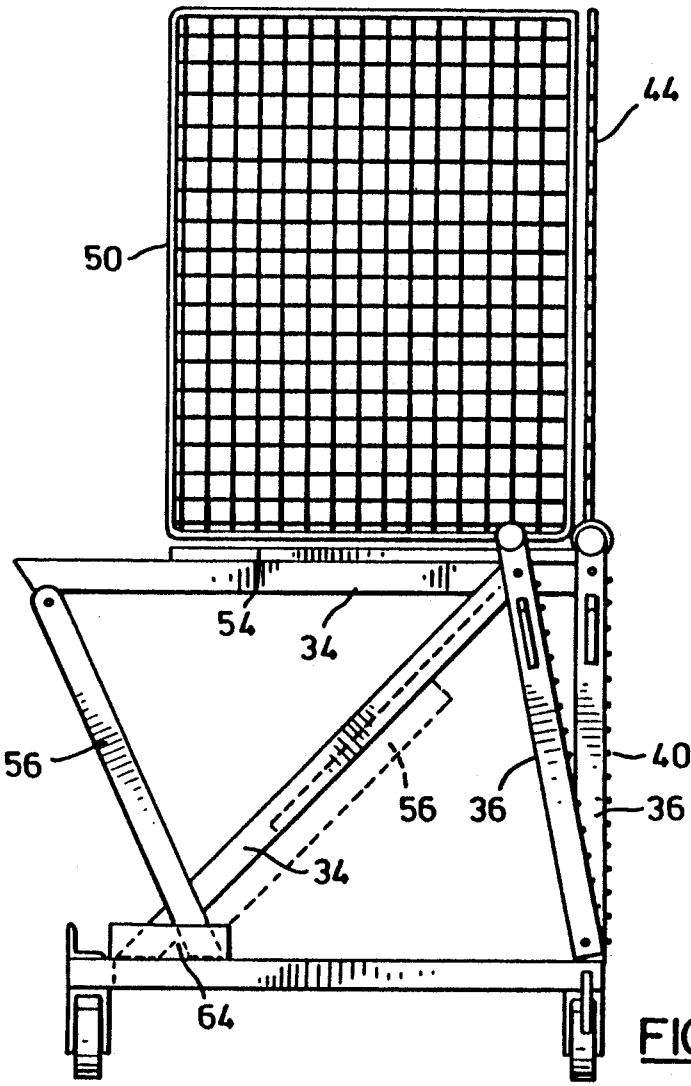
FIG. 7 is an end elevation of a third embodiment of support rack in unfolded condition.

FIG. 7 shows a modification of the arrangement shown in FIGS. 4 and 5 which provides a vertical face on the crowd side. The bottom ends of the struts 36 are hinged, and the struts 34 are hinged to the top ends of the struts 36, with the struts 56 hinged to the bottom ends of the struts 34. With this arrangement, this strut system can be moved between a folded position in which the struts 34 and 36 are in their normal position forming part of the support horse, and the struts 56 are folded parallel to the struts 34, and an extended position in which the struts 36 are locked in a vertical position, the struts 34 are raised to a horizontal position supporting the platform 54, and the struts 56 support the struts 34 from a block 64 providing sockets for the struts 56 when the unit is erected, and for the struts 34 when it is folded.

It will be understood that numerous arrangements are possible for providing a unit which is convertible between a support for the barrier units 2 and a barrier unit acting as a surveillance platform. Moreover, it would be possible to perform this conversion by linking a support platform to the away-from-crowd side of a regular barrier unit or units 2, so that the latter provide a continuous barrier without requiring the incorporation of screens into the lower portion of the units 4. In this case, the hooks 24 and 25 and eyes 26 would be omitted, but alternative means would be provided for temporarily linking the unit 4 behind a unit or units 2 to complete its conversion into a barrier unit.

In order to facilitate the handling of the units 4 when folded and stacked with units 2, they may be provided with couplings 66 so that several units 4 may be formed into a train for movement between a deployment site and the trailer 6 when it is more convenient to unload the trailer at a single point where obstruction to traffic can be avoided, or when direct access by large vehicles is not practicable.

Not only does a barrier according to the invention provide facilities for enhanced surveillance of a crowd or area being controlled, but this enhanced surveillance permits a substantial reduction in the number of security personnel required to man a given length of barrier. This may prove of great importance, particularly at large rallies or processions where the deployment of adequate numbers of security personnel is both expensive and difficult to arrange. Furthermore, the units 4, when assembled into the barrier, not only act as observation platforms but also as convenient depots for equipment used by security personnel. To this end, the units may incorporate equipment trays or lockers 68 mounted on the base frame 30 (see FIGS. 5 and 6), which can also double as stepping boxes providing an alternative surveillance platform when the platform 54 is not in use.

If an enhanced barrier system is required, a double row of units 2 may be erected back-to-back with their triangular base frames interlocking, and with units 4 located in either or both rows, as required. The system may also be used to provide a fence around a temporary enclosure or compound, complete with observation platforms for guards or officials. It is possible to replace some or all of the wire mesh screens on the units 4, and rearrange their disposition, so as to provide sentry boxes or booths for officials with some degree of wind and weather protection.

FIGS. 8, 9 and 10 show a preferred form of first barrier unit having significant advantages over that disclosed in the Appleby patent to which reference is made above. The Appleby barrier unit has a frame constructed from a single thickness of tubing with multiple bends and has welded Y-junctions. The bending process is complex, and a high standard of welding of the Y-junctions is required if the strength of the barrier is not to be prejudiced, since the welds occur at highly stressed points of the structure where crowd forces are transferred from the uprights to the bases of the barrier units. The actual strength of the barrier is limited by the resistance to bending at the lower ends of the upright lengths of tube at the ends of the barrier, which in turn limits the length of the barrier unit (since the bending forces applied to the uprights of the barrier will be proportional to its length) for a given type and gauge of tube. The type and gauge of tube has in turn a substantial bearing on the weight, cost and ease of handling of the barriers. The most practical length for the Appleby barrier, taking these factors into account, turns out to be about 5 feet.

I have found that by redesigning the Appleby barrier as shown in FIGS. 8, 9 and 10, I can produce, using galvanised steel tubing of the same gauge, a barrier unit having a length of about 8 feet with more than proportionate strength in the uprights and a comparatively small weight penalty, at a cost very similar to that of the 5 foot Appleby barrier. This means that a comparable length of barrier can be provided at five eighths of the cost, and whilst the individual units are heavier, there is no significant change in overall weight. Moreover, the reduced number of units required reduces handling, speeds assembly and simplifies storage.

In the unit of FIGS. 8–10, the frame is formed in two elements 100 and 102. A panel support frame element 100 is formed from a length of steel tubing bent to form spaced vertical members 104 and 106, and a connecting loop 108 extending in a horizontal plane to one side of a common vertical plane containing the vertical members. A panel 110 of steel wire mesh, typically of 0.125 inch diameter wire with a 2 inch mesh, is supported in the same vertical plane between tubular steel horizontal stringers 112 having flattened ends welded to the vertical members 104 and 106.

A perimeter frame element 102 has vertical portions 114 and 116 spaced so as to be externally adjacent and in the same vertical plane as the vertical members of element 100, a horizontal top bar 118 and a bottom loop 120 extending in a common horizontal plane with the loop 108 but to the opposite side of the vertical plane. The steel tubing forming the perimeter frame element is joined by welding, or by a tube connector, at a point which is not critically stressed and the vertical members 104 and 106 are connected by vertically extending welds 126 to the vertical portions 114 and 116 respectively, providing very strong vertical stanchions. Not only are these stanchions very strong, but no welds are required at the points of critical stress occurring at the transitions to the loops 108 and 120. Hooks 122 and eyes 124 are welded to the stanchions in manner similar to that shown and discussed with reference to FIG. 3 and in the Appleby patent. The assembled unit is galvanised to provide corrosion protection.

A further advantage of the improved barrier units is that they can be easier to transport to a site where they are used. Whilst the various transportation systems disclosed in this application have considerable advantages in the on-site deployment of barriers, care must be taken not to stack the barriers to too great a height, since such a stack will be both somewhat unstable and very heavy and according to the construction of the barrier units, may lean through offsets introduced by each barrier as the stack grows. I have found that the barriers of FIGS. 8–10, being conveniently manufactured in eight foot lengths, are also easily stacked horizontally for transportation on a cradle of longitudinal rails mounted on a standard truck or trailer chassis, for example similar to the trailer shown in FIG. 2. Each barrier unit is laid so as to extend widthwise across the chassis, the rails of the cradle supporting the top bar 118 of the first unit and the loop 108 of each horizontally nested unit. This enables the units to be nested horizontally along the length of the truck or trailer bed at a pitch not much in excess of the diameter of the tubing utilized to fabricate the units. The units may be taken off the cradle one by one as required for use.

The embodiments of the invention in which an exclusive property or privilege is claimed are defined as follows:

1. A portable dismountable barrier system comprising a plurality of separate, free-standing barrier units releasably connectable in end to end relationship to form an elongated barrier, said units comprising units of a first type and a plurality of units of a second type for each first unit, the units of the first type providing support for said plurality of second units for transportation when the barrier is in a dismounted condition, and an elevated surveillance platform when the barrier is in an assembled condition, in which the units of the first type have a wheeled base frame supporting a superstructure which in a first, folded condition forms a stacking horse for units of the second type, and in a second extended condition forms the elevated surveillance platform.

2. A system according to claim 1, further including a vehicle having a platform for receiving a plurality of units of the first type when stacked with units of the second type, and a loading ramp via which the units of the first type may be wheeled onto and off the vehicle.

3. A system according to claim 1, the platform having screens surrounding it on three sides.

4. A system according to claim 1, the superstructure comprising struts forming an inverted V-shaped frame at each end of the platform, and a cross rail joining the frames to form the stacking horse, parts forming the elevated stacking frame being pivotally mounted to the cross rail for movement between folded positions not projecting beyond the stacking horse, and extended positions forming a platform and screens surrounding the platform on three sides.

5. A free-standing barrier unit adapted to be connected in end to end interlocking relationship with adjacent free-standing barrier units of a second type, said barrier unit further comprising support for storage of a plurality of said second type of barrier units, and an elevated surveillance platform when the barrier unit is connected to adjacent units of said second type, comprising a wheeled base frame supporting a superstructure which in a first folded condition forms a support in the form of a stacking horse for units of the second type, and in a second extended condition forms said elevated surveillance platform, the superstructure comprising struts forming an inverted V-shaped frame at each end of the platform, and a crossrail joining the frames to form the stacking horse, parts forming the elevated stacking frame being pivotally mounted to the crossrail for movement between folded positions not projecting beyond the stacking horse, and extended positions forming the elevated surveillance platform and screens surrounding the platform on three sides.

6. A unit according to claim 5, wherein the base frame further supports a tray or locker.

7. A unit according to claim 5, including means to couple said unit to other similar units to form a train.

8. A barrier unit comprising a panel support frame element having spaced vertical members in a common vertical plane, a barrier panel extending between said vertical members in said vertical plane, and a horizontal member connecting bottom ends of said vertical members and forming a loop extending laterally to one side of said vertical plane, said vertical and horizontal members being formed by a single continuous length of rigid tubing; a perimeter frame element formed by a closed loop of rigid tubing, said perimeter frame element comprising vertical portions adjacent and secured to said vertical members, the adjacent vertical portions and vertical members together forming end stanchions, a lower horizontal portion forming a loop extending laterally to an opposite side of said vertical plane, and an upper horizontal portion in said vertical place above said barrier panel; vertically spaced hooks secured to one of said end stanchions; and vertically spaced eyes secured to the other of said end stanchions to receive the hooks of an adjacent barrier unit.

9. A barrier unit as claimed in claim 8, wherein the vertical members and vertical portions are connected by vertical welds.

* * * * *